US008297597B2

(12) United States Patent
Dalsmo et al.

(10) Patent No.: US 8,297,597 B2
(45) Date of Patent: Oct. 30, 2012

(54) METHOD FOR LIFT COMPENSATION

(75) Inventors: Jon Oystein Dalsmo, Kristiansand (NO); Jan Petter Svennevig, Homborsund (NO); Andreas Reppen, Jar (NO)

(73) Assignee: National Oilwell Varco Norway AS, Kristiansand (NO)

( * ) Notice: Subject to any disclaimer, the term of this patent is extended or adjusted under 35 U.S.C. 154(b) by 150 days.

(21) Appl. No.: 12/679,177

(22) PCT Filed: Sep. 15, 2008

(86) PCT No.: PCT/NO2008/000327

§ 371 (c)(1),
(2), (4) Date: Jul. 8, 2010

(87) PCT Pub. No.: WO2009/038468

PCT Pub. Date: Mar. 26, 2009

(65) Prior Publication Data

US 2010/0308289 A1 Dec. 9, 2010

(30) Foreign Application Priority Data

Sep. 19, 2007 (NO) ..... 20074777
Aug. 20, 2008 (NO) ..... 20083596

(51) Int. Cl.
*B66D 1/00* (2006.01)

(52) U.S. Cl. ..... 254/277; 254/274

(58) Field of Classification Search ..... 254/274, 254/275, 277

See application file for complete search history.

(56) References Cited

U.S. PATENT DOCUMENTS 3,743,249 A * 7/1973 van Daalen ..... 254/273
3,943,868 A * 3/1976 Person et al. ..... 114/264
4,004,532 A * 1/1977 Reynolds ..... 114/256
4,025,055 A 5/1977 Strolenberg
4,039,177 A * 8/1977 Person et al. ..... 267/126
4,535,972 A * 8/1985 Millheim et al. ..... 254/277
4,593,885 A 6/1986 Hackman et al.
4,688,764 A * 8/1987 Nayler et al. ..... 254/277
5,202,680 A * 4/1993 Savage ..... 340/853.1

(Continued)

FOREIGN PATENT DOCUMENTS

EP 0090741 A1 10/1983
GB 1511428 5/1978
GB 2132972 A 7/1984

(Continued)

OTHER PUBLICATIONS

PCT/NO2008/000327 International Search Report, Dec. 15, 2008.

*Primary Examiner* — Emmanuel M Marcelo

(74) *Attorney, Agent, or Firm* — Conley Rose, P.C.

(57) ABSTRACT

A method for lift compensation of an item (12) which is connected to a vessel (1) by means of a rope (4) which is coiled around the rope drum (6) of a lifting device (2), the lifting device (2) being provided with a heave compensator (20), a controller (30) of the heave compensator (20) controlling the effect of the driving device (32, 34, 42) of the rope drum (6) on the basis of a heave term and a deviation term, the method comprising: —bringing a correction term into the heave compensation when, because of environmental forces, the force on the rope (4) falls outside a first limit (d, e); and—leaving the correction term out when the force on the rope (4) is within a second limit (c, f), the second limit (c, f) being equal to or different from the first limit (d, e).

17 Claims, 3 Drawing Sheets

U.S. PATENT DOCUMENTS

| | | | | |
|---|---|---|---|---|
| 5,894,895 | A * | 4/1999 | Welsh | 175/5 |
| 6,082,947 | A | 7/2000 | Adamson | |
| 6,932,325 | B1 * | 8/2005 | Selcer et al. | 254/275 |
| 7,731,157 | B2 * | 6/2010 | Davidson | 254/277 |
| 7,798,471 | B2 * | 9/2010 | Christopher | 254/277 |
| 7,934,561 | B2 * | 5/2011 | Ormond | 166/355 |
| 2005/0242332 | A1 | 11/2005 | Ueki et al. | |
| 2007/0017889 | A1 | 1/2007 | Schobesberger | |

FOREIGN PATENT DOCUMENTS

| | | | |
|---|---|---|---|
| WO | 9100236 | A1 | 1/1991 |
| WO | 0142126 | A1 | 6/2001 |
| WO | 0227684 | A1 | 4/2002 |
| WO | 2005090226 | A1 | 9/2005 |
| WO | 2007067055 | A1 | 6/2007 |
| WO | 2008022125 | A1 | 2/2008 |

* cited by examiner

METHOD FOR LIFT COMPENSATION

CROSS-REFERENCE TO RELATED APPLICATIONS

The present application claims the benefit of priority to PCT/NO2008/000327 filed Sep. 15, 2008, which claims the benefit of Norwegian Application No. 20074777 filed Sep. 19, 2007 and Norwegian Application No. 20083596 filed Aug. 20, 2008, all of which are incorporated herein by reference in their entireties for all purposes.

STATEMENT REGARDING FEDERALLY SPONSORED RESEARCH OR DEVELOPMENT

Not applicable.

This invention relates to a method for lift compensation. More particularly it relates to a method for the lift compensation of an item which is connected to a vessel by means of a rope, the rope being coiled around the rope drum of a lifting device and the lifting device being provided with a heave compensator, a controller in the heave compensator controlling the effect of the driving device of the rope drum on the basis of a heave term and a deviation term.

By a rope is meant any form of a load-carrying, flexible component such as a wire, fibre rope or chain.

During hoisting operations from a vessel it is necessary, especially when great load weights are involved, to heave compensate the load. The purpose of heave compensation is to hold an item at rest relative to the seabed, alternatively to move the item at a constant speed relative to the seabed even if the vessel is subjected to movements which may be caused by the pitching, rolling or heave of the vessel.

According to the prior art, the unspooling and spooling of the rope from/to a rope drum is controlled in a heave-compensated manner at least on the basis of measured values for the speed of the feed-out point of the vessel, spooling speed and the current position of the item relative to the desired position. The feed-out point of the vessel is typically constituted by the bearing portion of a rope sheave. The measured signal values are often processed in a programmable logic controller PLC which increases the effect of the drive of the rope drum on the basis of the measured values and selected constants.

For example, the speed of the feed-out point can be calculated and compared with the spooling speed of the rope drum. If the purpose is to hold the item at rest, these speeds should ideally be of 100% opposite phase.

US patent application 2005/0242332 discloses a system for heave compensation, in which the speed of the item is kept constant during movement of the item in the water.

Items which are hoisted from or to a vessel through the water are subjected to environmental forces in the form of current, and during hoisting through the splash zone also of waves and wind.

Items of a limited physical size are not particularly subject to forces of this kind, and the additional forces that occur will normally be within the capacity that the lifting equipment is dimensioned to carry. However, it has turned out that some structures, for example suction anchors which are provided with relatively big horizontal surfaces, may bring indefensibly large forces upon the lifting equipment as they are hoisted through the splash zone. Therefore, it is often necessary to wait for sufficiently good weather before operations of this kind can be started.

As larger items are to be lifted, the influence of forces from the environment is intensified. It is virtually impossible to have an overview of how large additional forces may be expected, for example from waves breaking over a relatively large lattice structure as it is lowered through the splash zone.

The invention has for its object to remedy or reduce at least one of the drawbacks of the prior art.

The object is achieved according to the invention through the features which are specified in the description below and in the claims that follow.

There is provided a method for the lift compensation of an item connected to a vessel by means of a rope coiled around the rope drum of a lifting device, the lifting device including a heave compensator, a controller in the heave compensator controlling the effect of the driving device of the rope drum on the basis of a heave term and a deviation term. The method is characterized by comprising:

bringing a correction term into the heave compensation when, owing to environmental forces, the force on the rope falls outside a first limit; and leaving the correction term out when the force on the rope is within a second limit, the second limit being equal to or different from the first limit.

The deviation term may be left out or assigned a reduced contribution in the controller when the correction term is brought in.

The first limit may be constituted by the minimum or maximum admissible force on the rope, whereas the second limit may be constituted by the minimum or maximum usable force on the rope.

Somewhat simplified it may be said that heave compensation according to the prior art is controlled by a heave term calculated on the basis of the speed of the feed-out point and the rope speed. The heave term influences the controller to increase the effect of the driving device such that the resulting speed will be zero, that is to say the two speeds are of 100% opposite phase. Thereby the item is kept at rest relative to the seabed.

The prior art also includes a position deviation term, here called a deviation term, which is arranged, for example, to provide for the item to be raised or lowered at a steady speed relative to the seabed. The deviation term is calculated from a position deviation which constitutes the difference between the current item position and the desired item position. The deviation term influences the controller to change the effect of the driving device to reduce the position deviation.

In accordance with the invention, a correction term is also brought in whenever necessary. When the current force on the rope falls outside the predetermined first limit, the correction term is brought in, so that the rope is fed in or out in a controlled manner until the force on the rope is within the second limit, after which the correction term is left out again.

The correction term includes the sum of the difference between the current force on the rope and the force from the item's own weight, and a constant which is determined from, among other things, the desired correction response and the structure of the relevant lifting device. The purpose of the correction term is to contribute to the force on the rope not getting outside a first limit.

In a preferred embodiment the error term from the position deviation, the deviation term, is left out when the correction term is brought in. The heave compensation will then be controlled not only on the basis of the speeds of the feed-out point and the rope, but also on the basis of the deviation existing between the force from the item's own weight and the current force on the rope.

When, for example, a wave breaks over an item which is in the splash zone, the force on the rope may increase considerably and to a value which is higher than the first limit. Thereby the correction term is brought in while, at the same time, the deviation term does not influence the controller any longer, or at least does not influence the controller to the same extent any longer. The correction term will influence the feeding out of rope until the force is within the determined, maximum value even if it gives an increased position deviation. When the force on the rope gets to be within the second limit, the correction term is left out, the deviation term again being assigned a normal contribution in the controller in order to pick up any position deviation that may have arisen.

Other conditions, such as within which ranges of the lifting height said compensation may set in, are chosen on the basis of the compensation desired and the prevailing conditions, among other things. The compensation influence from the heave term, deviation term and correction term may differ under different conditions and at different depths.

The method according to the invention provides a relatively simple solution to the task of holding an item in a desired position relative to the seabed while avoiding, at the same time, an overloading of the lifting equipment, which might arise during some parts of the hoisting operation.

In what follows is described an example of a preferred method which is visualized in the accompanying drawings, in which.

Figure 1:
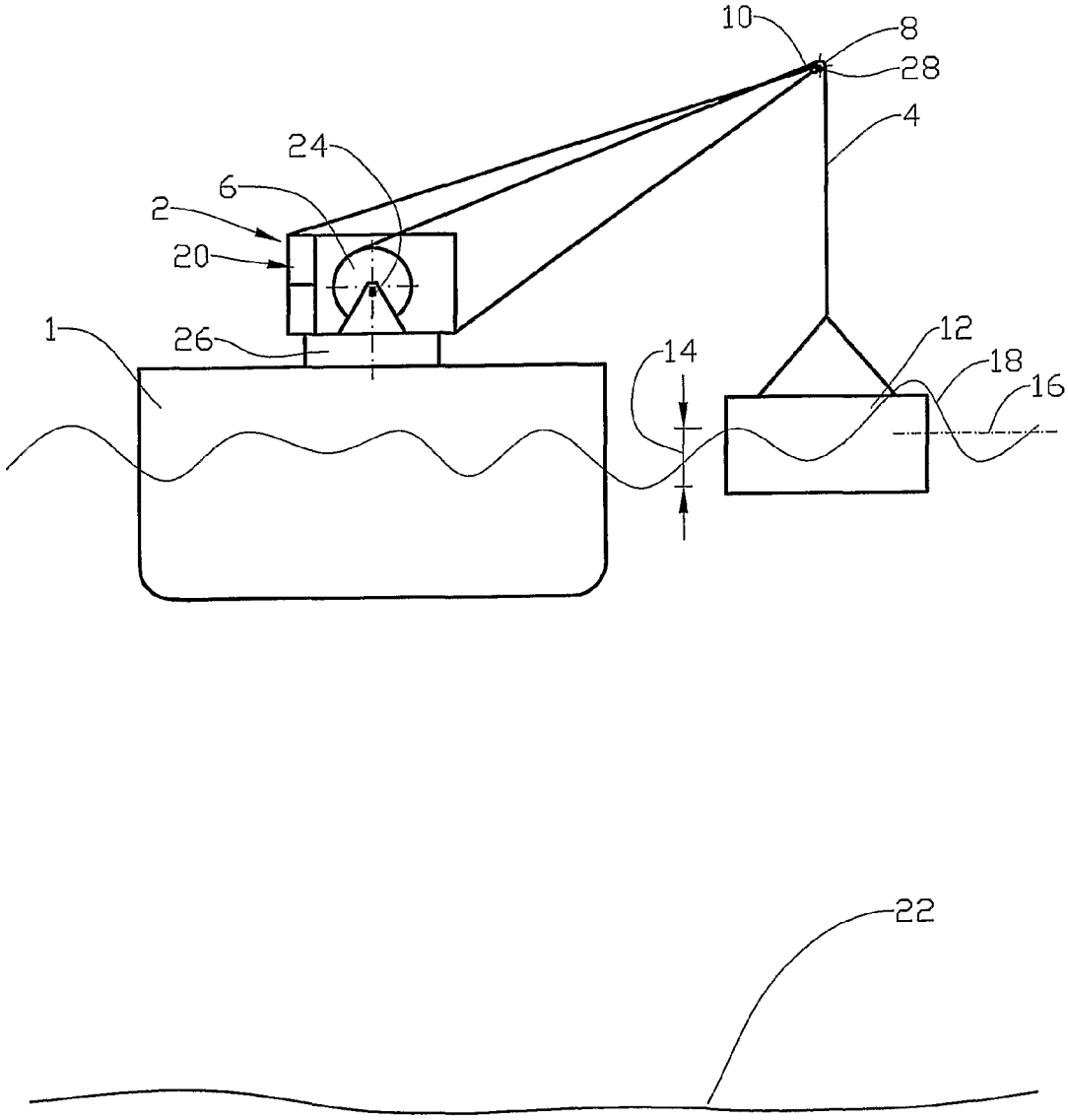
FIG. 1 shows a principle drawing of a vessel provided with lifting equipment, an item being hoisted through the splash zone.
Figure 2:
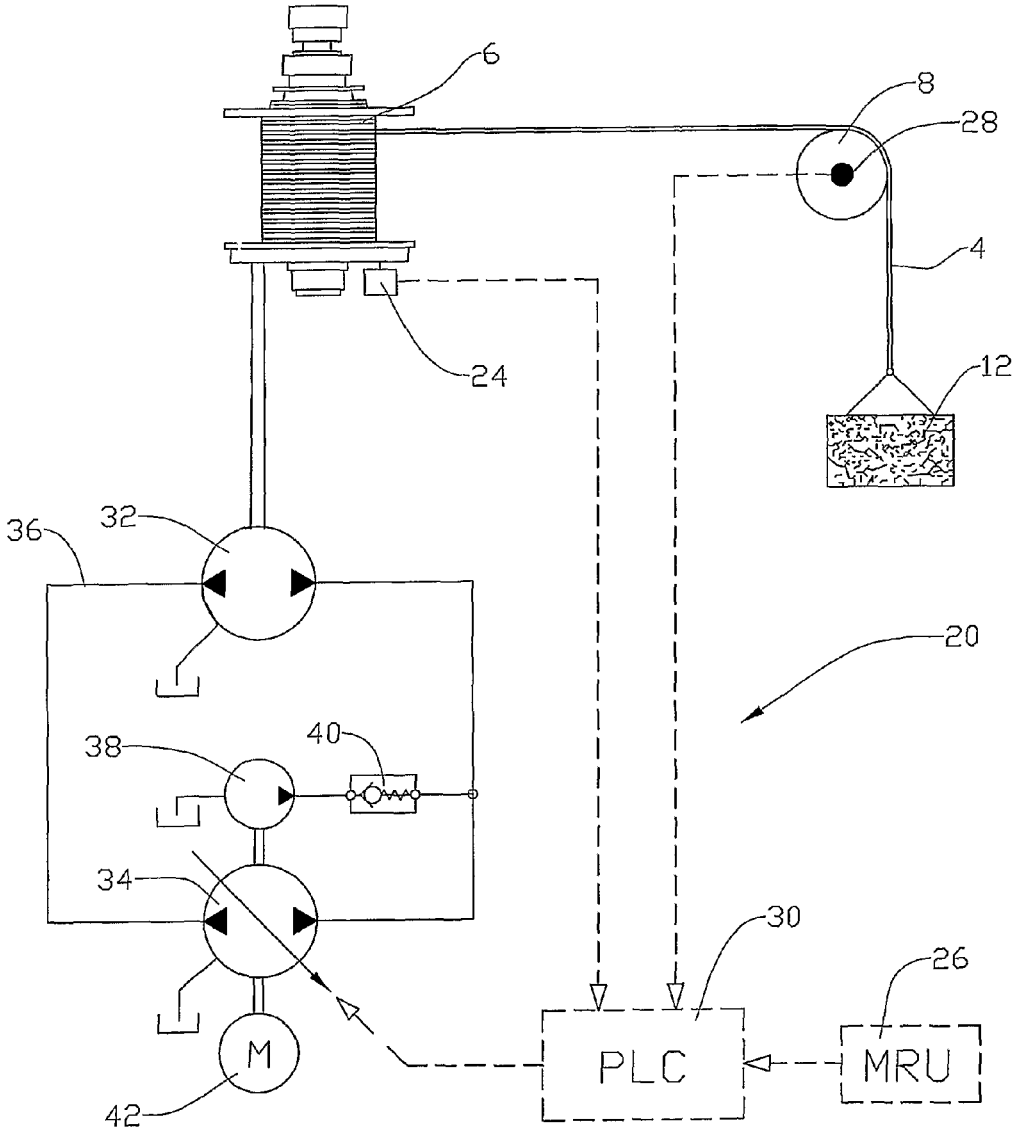
FIG. 2 shows schematically components of the lift compensation system.

In the drawings the reference numeral 1 indicates a vessel which is provided with a lifting device 2 in which a rope 4 is fed out from a rope drum 6 and over a rope sheave 8 at the outer beam portion 10 of the lifting device 2. An item 12 is in a splash zone 14 at the sea surface 16.

The item 12 which is being lowered is subjected to environmental strains in the form of forces from currents and waves 18 breaking over the item 12.

A heave compensator 20 is arranged to control, in a manner known per se, the speed of the rope drum 6 in such a way that the item 12 stays in a particular position relative to the seabed 22 even if the outer beam portion 10 is moved. Alternatively, the heave compensator 20 maintains a constant, controlled hoisting speed relative to the seabed 22.

The heave compensator 20 receives signals on the spooling speed from a transmitter 24 and signals from an accelerometer 26 positioned at the attachment of the lifting device 2 to the vessel 1, the signal from the transmitter 24, apart from indicating the spooling speed, also forming the basis for calculating the length of rope fed out, and the measured value from the accelerometer 26 forming the basis for calculating the speed and acceleration of the outer beam portion 10.

The heave compensator 20 also receives information from a load cell 28 at the rope sheave 8 to be able to calculate a correction term. The correction term is calculated by adding the difference between the current force on the rope 4 and the force from the item's 12 own weight, and a constant contribution. The contribution is constant as long as the correction term is brought in, and has a sign depending on whether it is an upper or lower first limit that has been reached. The contribution is determined during the running-in of the load compensation.

In this preferred exemplary embodiment, the rope drum 6 is driven by a hydraulic motor 32 which is supplied with pressure fluid from a variable hydraulic pump 34 in circulation via a pipe 36. Whenever needed, a feed pump 38 supplies the hydraulic pump 34 with fluid via a check valve 40. A motor 42 drives the hydraulic pump 34 and the feed pump 38. The hydraulic motor 32, hydraulic pump 34 and motor 42 constitute main elements in the driving device of the rope drum 6.

Prior art heave compensation is thus based on measured values from the accelerometer 26, which is often termed an MRU (motion reference unit), being transmitted to a controller 30. The controller 30 which may be constituted by a programmable logic controller PLC converts the signals from the accelerometer 26 into giving the speed and acceleration of the outer beam portion 10. The controller 30 receives information on the spooling speed of the rope drum 6 from the transmitter 24. To hold the item 12 at rest relative to the seabed 22, the controller 30 provides an increased effect to the hydraulic pump 34 on the basis of the speed of the outer beam portion 10 and the spooling speed, here called the heave term, causing the spooling speed to be approximately in opposite phase to the speed of the beam portion 10.

If the item 12 is to be moved at a steady speed relative to the seabed 22, the current item position is compared with the desired position. Information on the current item position is calculated on the basis of the signal from the transmitter 24. The position deviation, forming the basis for the deviation term, influences the controller 30 to provide an increased effect to the hydraulic pump 34 to achieve the desired item position. All terms are corrected by means of individual constants which have emerged during the adjustment of the heave compensator 20.

Figure 3:
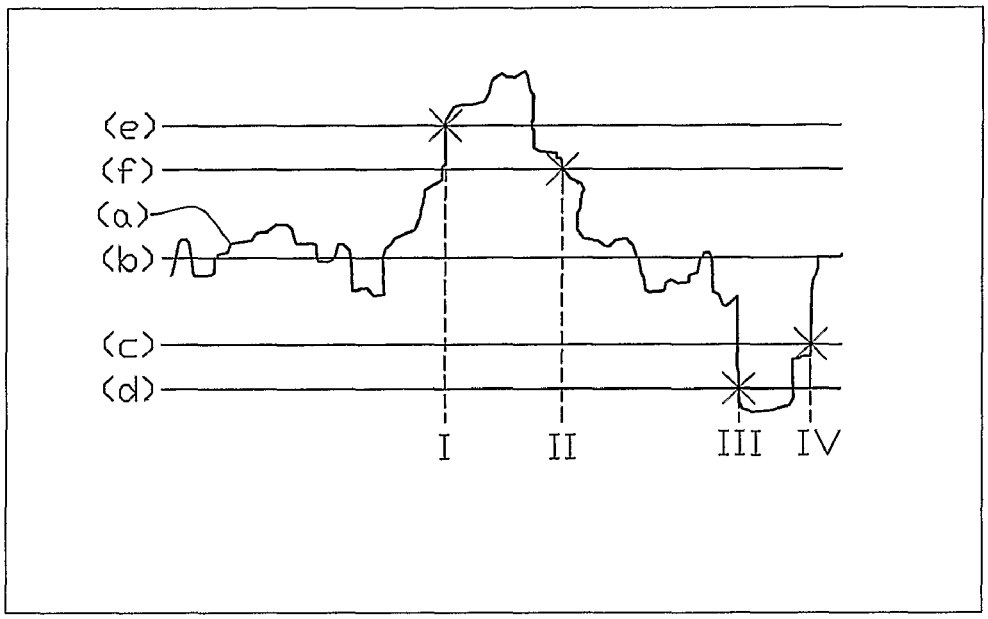
FIG. 3 shows a graph of the current force over time with the use of a prior art heave compensator.

As the item 12 is lowered through the sea surface 16, the item 12 is subjected to forces from waves 18 breaking over the item 12. The force on the rope 4 is shown in FIG. 3, in which the curve a denotes the tensioning of the rope 4 over a period of time. In FIG. 3 the line b denotes the force from the item's 12 own weight, line c the minimum usable force on the rope 4, line d the minimum admissible force on the rope 4, line e the maximum admissible force on the rope 4 and line f the maximum usable force on the rope 4. The curve a shows the force on the rope 4 with the use of prior art heave compensation.

During the lowering of the item 12 through the sea surface 16, see curve a in FIG. 3, the feeding speed of the rope drum 6 is controlled by the heave compensation in a manner known per se. At the time I the item is affected by waves 18 causing the force on the rope 4 to rise above the allowed limit e. According to the invention the correction term is then brought into the control, causing the rope 4 to be fed faster in order not to exceed the maximum admissible force e, after which the correction term being left out completely or partially, which means that the speed of the item 12 relative to the seabed 22 is changed. The force on the rope 4 when the correction term is brought in is shown in curve g of FIG. 4. The forces d and e thus constitute a first limit, whereas the forces c and f constitute a second limit.

At the time II the force on the rope has dropped to the desired maximum force f, whereby the correction term is left out and heave compensation in accordance with the prior art is resumed.

Correspondingly, at the time III, at which the force on the rope 4 falls below the minimum admissible force d. Then the correction term is brought in, tightening the rope 4, see is curve g of FIG. 4. At the time IV the force has been increased to the minimum usable force c, and conventional heave compensation is resumed.

Figure 4:
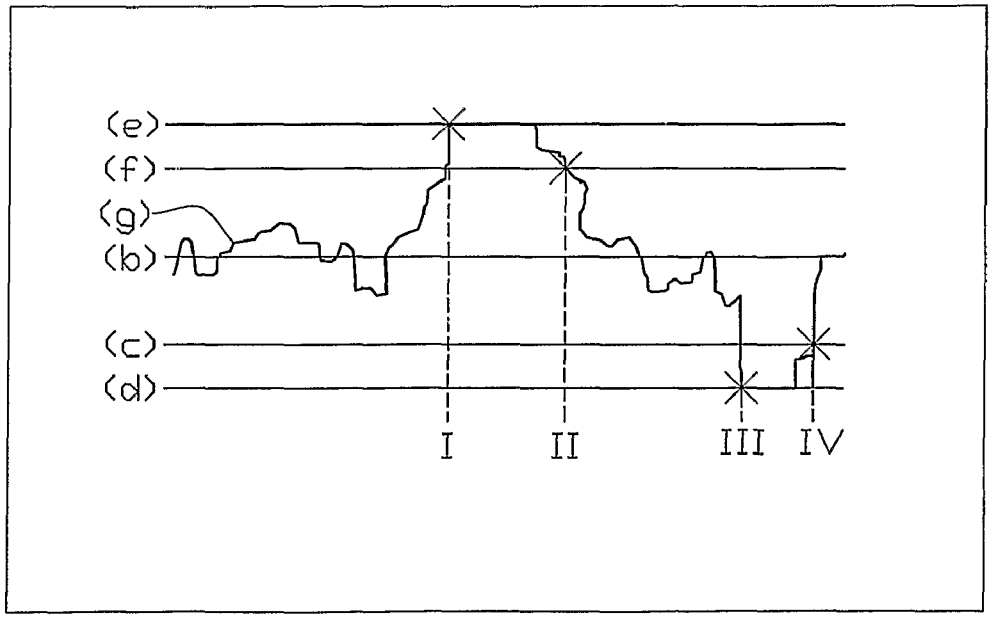
FIG. 4 shows a graph of the current force over the same time as that in FIG. 3 but with the use of load compensation according to the invention.

Thus, load compensation according to the invention has the effect of the force on the rope 4, see curve g of FIG. 4, being prevented from exceeding the maximum admissible force e or go beyond the minimum admissible force d.

In deeper water currents, not shown, may also occur which may affect the item 12 sufficiently for the correction term to be brought in periodically.

The invention claimed is:

1. A method for lift compensation of an item connected by a rope to a lifting device disposed on a vessel, wherein the lifting device comprises a heave compensator arranged to control a speed of a rope drum, the method comprising:

with the heave compensator, controlling the rope drum of the lifting device according to a calculated contribution comprising a heave term and a deviation term, wherein the deviation term is calculated from a difference between a current position of the item and a selected position of the item;

monitoring a force on the rope; and bringing in a correction term into the calculated contribution for the heave compensator when the force is above a first upper limit or below a first lower limit, wherein the correction term is determined to feed rope faster from the rope drum when the force is above the first upper limit and to tighten the rope when the force is below the first lower limit.

2. The method of claim 1, further comprising:

removing the correction term when the force is between a second lower limit and a second upper limit.

3. The method of claim 1, wherein the deviation term in the calculated contribution of the heave compensator is left out as the correction term is brought in.

4. The method of claim 1, wherein the deviation term in the calculated contribution of the heave compensator is assigned a reduced contribution as the correction term is brought in.

5. The method of claim 1, wherein the heave compensator is controlling the rope drum to maintain the item in a selected position relative to a seabed.

6. The method of claim 1, wherein the heave compensator is controlling the rope drum to maintain the item at a constant speed relative to the seabed.

7. The method of claim 1, wherein the force on the rope is monitored by a load cell configured to monitor force on a rope sheave at an outer beam portion of the lifting device.

8. The method of claim 1, wherein the correction term is calculated by adding a selected constant contribution for the heave compensator and a difference between the force on the rope and the weight of the item.

9. A lifting device disposed on a vessel, the lifting device comprising:

a rope drum;

a rope sheave;

a rope wrapped around the rope drum and extending over the rope sheave;

a load cell configured to monitor force on the rope sheave;

a heave compensator configured to control a drive device for the rope drum and comprising a programmable logic controller configured to:

receive force information from the load cell;

increase the rope feed from the rope drum based on the force on the rope sheave exceedings a maximum allowable force; and tighten the rope on the rope drum based on when the force on the rope sheave dropping below a minimum allowable force.

10. The lifting device of claim 9, wherein the heave compensator is configured to control the rope drum according to a calculated contribution comprising a heave term and a deviation term, wherein the deviation term is calculated from a difference between a current position of an item suspended from the rope and a selected position of the item.

11. The lifting device of claim 10, wherein the programmable logic controller is configured to bring a correction term into the calculated contribution for the heave compensator based on the force on the rope being above a first upper limit or below a first lower limit; feed rope faster from the rope drum based on the force on the rope sheave exceeding the first upper limit; and tighten the rope on the rope drum based on the force on the rope sheave dropping below the first lower limit.

12. The lifting device of claim 11, wherein the programmable logic controller is configured to remove the correction term based on the force being between a second lower limit and a second upper limit.

13. The lifting device of claim 11, wherein the programmable logic controller is configured to leave the deviation term out of the calculated contribution of the heave compensator as the correction term is brought into the calculated contribution.

14. The lifting device of claim 11, wherein the programmable logic controller is configured to assign a reduced contribution of the deviation term in the calculated contribution of the heave compensator as the correction term is brought into the calculated contribution.

15. The lifting device of claim 11, wherein the correction term is calculated by adding a selected constant contribution for the heave compensator and a difference between the force on the rope and the weight of the item.

16. The lifting device of claim 9, wherein the heave compensator is configured to control the rope drum to maintain the item in a selected position relative to a seabed.

17. The lifting device of claim 9, wherein the heave compensator is configured to control the rope drum to maintain the item at a constant speed relative to a seabed.

* * * * *